United States Patent [19]

Burkus

[11] Patent Number: 4,610,798

[45] Date of Patent: Sep. 9, 1986

[54] METHOD AND COMPOSITION OF MATTER FOR CONDITIONING AND PASSIVATING CERTAIN METALS

[76] Inventor: Michael Burkus, 796 Bear Rd., Berwyn, Pa. 19312

[21] Appl. No.: 723,817

[22] Filed: Apr. 16, 1985

[51] Int. Cl.[4] ..... C09K 13/04; C23G 1/02; C23F 1/00; B44C 1/22

[52] U.S. Cl. ..... 252/79.2; 134/3; 156/664; 156/903; 252/142; 427/399

[58] Field of Search ..... 148/18, 20.6, 28; 252/79.2, 142; 156/664, 903; 134/3, 41; 427/399

[56] References Cited

U.S. PATENT DOCUMENTS 3,523,825 8/1970 Callahan et al. ..... 134/3 X 3,787,239 1/1974 Schroeder et al. ..... 252/79.2 X

*Primary Examiner*—William A. Powell

*Attorney, Agent, or Firm*—Lipton & Famiglio

[57] ABSTRACT

A method for preparing and using a certain conditioning and passivation composition on metals and the composition of matter used for such conditioning and passivation, which method involves immersing the metal in a bath consisting of specified quantities of nitric acid, sulfuric acid and chromium trioxide in water. The treatment produces a clean and bright surface on the metal that is resistant to corrosion, without attacking the substrate metal. The passivation composition of the present invention can be used as a final passivation and corrosion removal treatment for stainless steel and as a corrosion removal and passivation treatment for other non ferrous metals.

4 Claims, No Drawings

METHOD AND COMPOSITION OF MATTER FOR CONDITIONING AND PASSIVATING CERTAIN METALS

BACKGROUND OF THE INVENTION

1. Field of Invention

The present invention relates to an improved method and composition of matter that can be used following a metal degreasing process as a final treatment to attack and remove contaminants on the surfaces of such metals as stainless steel, brass, copper and aluminum (e.g. after an etching process), without attacking the base metal itself. The treatment leaves a passivated, bright surface on the metal that is resistant to corrosion.

In the fabricating and finishing of such metals as the stainless steels, several cleaning and conditioning operations are necessary. Methods for removing foreign contaminants, such as lubricants, paints, shop dust etc. and for mechanical or chemical descaling and stress tempering, followed by acid pickling and baking, are known to those skilled in the art. Pickling operations leave a dull, smutty finish on the steel. In addition, the various machining processes leave a thin layer of various metals on the surface of the base metal along with other impurities which form rust and other oxides in the presence of air.

As a final conditioning process in the manufacture of stainless steels, it is, therefore, desirable to remove oxides or rust from the surface of the stainless steel, and to make the metal surface more resistant to corrosion by exposing it to compounds known as passivators. A passive metal, or an alloy composed of passive metals, is one that would ordinarily be chemically active in the Emf Series but which has had its activity decreased to a level resembling the activity of a noble metal. In general, the substances that promote passivation of metals are certain inorganic oxidizing agents that react slowly with the surfaces of the metal. It is thought that the unique action of the passivators results either from the immediate formation of a film, such as a metal oxide, on the surface of the metal, that serves as a diffusion barrier and that separates the metal from the surrounding environment or that the metal surface becomes covered by a chemisorbed film which decreases the rate of metalic hydration, thus decreasing the propensity of the metal to corrode.

It is believed that iron and other transition metals, which characteristically have uncoupled electrons in their "d" shells, form strong bonds with environmental components such as oxygen, with its own uncoupled electrons, resulting in the initial formation of a chemisorbed film, that, in time, forms a more stable metal oxide. Once the metal is passivated, further corrosion is resisted, even in formerly corrosive environments such as strong acids. See discussion of passivators in H. H. Uhlig "Corrosion and Corrosion Control" 2nd Ed. John Wiley & Sons, New York, New York 1971.

Among the final conditioning and passivating treatments currently in use for stainless steel, is a warm solution of nitric acid or of nitric acid plus oxidizing salts (e.g. sodium dichromate). See Working Data Carpenter Stainless Steels, Copyright Carpenter Technology Corporation, 1980 at page 173. The present treatments of stainless steels have proved deficient, however, as they do not effectively remove rust and other oxides from the surface of the metal prior to the passivation of the metal's surface. The resulting surface may be contaminated and subject to further corrosion.

It is therefore the object of the present invention to provide a composition that both effectively removes impurities from a metal's surface and passivates the metal surface without attack of the metal surface.

It is also the object of the present invention to provide a method of applying a composition that effectively removes impurities from a metal's surface and passivates the metal's surface.

In general, the present invention presents an improved composition for conditioning metals and an improved method for using the composition for the treatment of the surfaces of metals so that the resulting passivated metal surfaces are free from contaminants that would weaken the metals' resistance to corrosion. It is believed that this improved conditioning result is achieved by lowering the ph of the treatment bath from the approximately 3 to 4 of the commonly used nitric acid-sodium dichromate treatment to a ph of under 2.00 and by combining nitric acid, sulfuric acid and chromium trioxide in the quantities detailed in this patent application. Using the composition of the present invention, complete conditioning of the metal can occur without attack of the substrate metal by the surrounding strong acids.

2. Description of the Prior Art

A number of passivation compositions and methods appear in the patent literature. U.S. Pat. No. 3,615,913 teaches passivation of exposed surfaces by first forming electrical insulator oxides on such surfaces then further protecting the metal surfaces by coating them with a protective coating material from the group consisting of polyimides and polyamide-polyimides. In U.S. Pat. Nos. 3,790,481 and 3,914,179, various synthetic lubricants for turbines include metal passivation components such as the aminobenzamide-type compounds to impart anticorrosion characteristics to copper and other metals with which they are in contact. In U.S. Pat. No. 3,922,395, inorganic oxidizing agents such as nitrites, chromates, tungstates and molybdates have also been used in a method of reducing or eliminating the formation of localized coating discontinuities, by first cleaning and by passivating the metal surface to be coated, in processes where a polymeric coating is later applied to the ferrous metal surfaces. U.S. Pat. No. 3,287,237 teaches improvement of the surface quality of stainless steel by treatment with organic acids. The previously metioned patents do not use the sulfuric acid-nitric acid mixture with the chromium trioxide component in the proportions to be described.

SUMMARY OF THE INVENTION

The present invention is a method and a composition of matter for the final conditioning of metals to promote the formation on the surface of the metals of a uniform corrosion resistant passivated surface, free from contaminants. One example is where the starting material is stainless steel that has previously been descaled, cold drawn or machined. The method involves first, removing grease & oil from the surface by solvent and vapor degreasing, then rinsing the metal, then immersing the metal in a bath composed of specific quantities of nitric acid, sulfuric acid, water and chromium trioxide. The bath is formulated to produce a solution having a ph of lower than 2.00. Chemical activity in solution allows for the removal of all foreign metal oxides and any shavings of elemental metal material on the metal surface. Passivation results in the eventual formation of a thin film of chromic oxides and iron oxides on the surface during the process. Passivation begins while the metal is in solution and continues upon its coming in contact with air. After a double cold water, agitated rinse a bright passivated surface on the metal is produced. No subsequent treatment is required to maintain passivity.

DESCRIPTION OF THE PREFERRED PROCEDURE

In the preferred procedure, the surface of the alloy or metal that is to be conditioned is first cleaned to remove grease, oil, drawing compounds, shop dirt and paints, using solvents or by vapor degreasing. All solvents are then allowed to evaporate from the surface. After this initial cleaning, the metal or alloy is rinsed in cold water and dried prior to immersion in the conditioning solution. No alkaline cleaners may be used prior to conditioning because such cleaners have a neutralizing effect on the composition claimed in this invention.

All tanks used for immersion must be made of acid resistant material. A separate immersion bath should be provided for each metal or alloy to be treated.

The dry metal or alloy is then immersed in a conditioning solution, consisting essentially of nitric acid, sulfuric acid, chromium trioxide and water, as described below, that has been preheated to a temperature of between 170° and 212° F. The usual conditioning period is thirty (30) minutes, however, immersion can occur for a shorter period if contamination of the surface is light or for a longer period if there is visible corrosion remaining on the metal surface. After immersion, the cleaned and passivated metal or alloy is then rinsed twice in an agitated cold water rinse. Care should be taken to avoid air pockets so as to insure that no conditioning solution remains on the surface of the metal when the metal is removed from the treatment bath. The treated metal is then air blown dry.

DESCRIPTION OF THE PREFERRED COMPOSITION

The preferred composition of the conditioning solution contains, per gallon of solution, twelve (12) fluid ounces of 71% nitric acid, four (4) fluid ounces of 93% technical grade sulfuric acid and two (2) ounces of solid chromium trioxide. Water is added to increase the volume to one gallon.

Although the present invention has been described with reference to the particular embodiment herein set forth, it is understood that the present disclosure has been made only by way of example and that numerous changes in the details of the method and changes in the exact quantities of the components of the composition may be resorted to without departing from the spirit and scope of the invention. Thus, the scope of the invention should not be limited by the foregoing specification, but rather only by the scope of claims appended hereto.

What is claimed is:

1. An acqueous conditioning and passivation solution comprising:

(a) an acqueous solution of nitric acid, containing from 4 fluid ounces to 24 fluid ounces, by volume, of 71% nitric acid, per gallon of solution;

(b) an acqueous solution of sulfuric acid containing 2 fluid ounces to 8 fluid ounces, by volume, of 93% sulfuric acid, per gallon of solution;

(c) from 1 ounce to 5 ounces, by weight, of solid chromium trioxide, per gallon of solution;

(d) water to make up the difference between the volume of liquids and solids in said solution of nitric acid, said solution of sulfuric acid and said chromium trioxide and one gallon of solution.

2. The composition, as defined in claim 1 wherein the ph of the solution is lower than 2.00.

3. The composition, as defined in claim 1, wherein the temperature of such solution is from 170° F. to 212° F.

4. The composition, as defined in claim 1 wherein the ph of the solution is lower than 2.00 and the temperature is from 170 170° F. to 212° F.

* * * * *